US009322215B2

(12) United States Patent
Kurzer et al.

(10) Patent No.: US 9,322,215 B2
(45) Date of Patent: Apr. 26, 2016

(54) LADDER LEVELER APPARATUS

(71) Applicant: Jershon, Inc., Shelby, MI (US)

(72) Inventors: Rodney Kurzer, Hart, MI (US); Brian D. Webster, Clearfield, UT (US); Geoffrey R. White, Orem, UT (US); Steven A. Owen, Provo, UT (US); Tyler L. Sharp, Provo, UT (US); Kenneth S. Bostwick, Provo, UT (US); Gregory L. Bishop, Cedar Hills, UT (US)

(73) Assignee: Jershon, Inc., Shelby, MI (US)

( * ) Notice: Subject to any disclaimer, the term of this patent is extended or adjusted under 35 U.S.C. 154(b) by 4 days.

(21) Appl. No.: 14/242,311

(22) Filed: Apr. 1, 2014

(65) Prior Publication Data

US 2014/0291072 A1 Oct. 2, 2014

Related U.S. Application Data

(60) Provisional application No. 61/807,582, filed on Apr. 2, 2013.

(51) Int. Cl.
*E06C 7/44* (2006.01)
*E06C 7/46* (2006.01)

(52) U.S. Cl.
CPC ... *E06C 7/44* (2013.01); *E06C 7/46* (2013.01); *Y10T 29/49813* (2015.01)

(58) Field of Classification Search
CPC ..... E06C 7/44; E06C 7/46
See application file for complete search history.

(56) References Cited

U.S. PATENT DOCUMENTS

| | | | | | |
|---|---|---|---|---|---|
| 816,914 | A | * | 4/1906 | Hinckley | 182/111 |
| 1,651,863 | A | | 12/1927 | Bauer | |
| 2,371,460 | A | * | 3/1945 | Needham | 182/204 |
| 2,458,076 | A | | 1/1949 | Houston | |
| 2,894,670 | A | * | 7/1959 | Anderson et al. | 182/202 |
| 2,936,849 | A | | 5/1960 | Larson | |
| 3,027,969 | A | | 4/1962 | Erickson | |
| 3,233,702 | A | | 2/1966 | Feltrop | |
| 4,128,139 | A | * | 12/1978 | Cook, Sr. | 182/202 |
| 4,497,390 | A | | 2/1985 | Wilson | |
| 4,565,262 | A | | 1/1986 | Hawkins | |

(Continued)

FOREIGN PATENT DOCUMENTS

| | | |
|---|---|---|
| SU | 985233 | 12/1982 |
| UA | 693 | 11/2000 |

OTHER PUBLICATIONS

International Search Report and Written Opinion of the International Searching Authority dated Aug. 7, 2014 (International Application No. PCT/US 2014/032653).

*Primary Examiner* — Alvin Chin-Shue
(74) *Attorney, Agent, or Firm* — Price Heneveld LLP

(57) ABSTRACT

A ladder includes a leveler engages a bottom of each side rail for 1) causing extendable legs to move to a level ground-engaging position, 2) causing the legs to lock when both legs engage the ground, and 3) causing the extendable legs to move to a centered/retracted position when lifted from the ground. The leveler includes pawls, links, pinions, and a shaft forming a four-bar linkage for selectively moving the pawls inward to the disengaged position when the pinion and shaft are each freely rotatable, but selectively moving the pawl outward into locking engagement when the shaft resists movement due to ground engagement by both legs. The leveler can be constructed to attach to an inside of the side rails, thus facilitating pre-assembly.

18 Claims, 12 Drawing Sheets

(56) References Cited

U.S. PATENT DOCUMENTS

| | | | | | |
|---|---|---|---|---|---|
| 4,627,516 | A | * | 12/1986 | Studer | 182/202 |
| 4,770,275 | A | * | 9/1988 | Williams | 182/202 |
| 5,007,503 | A | | 4/1991 | Sturm | |
| 5,273,133 | A | * | 12/1993 | Thocher et al. | 182/202 |
| 5,507,364 | A | | 4/1996 | Spevak | |
| 5,526,898 | A | | 6/1996 | Clark | |
| 6,237,718 | B1 | | 5/2001 | Schwarzel | |
| 6,336,521 | B1 | | 1/2002 | Dennis | |
| 6,435,306 | B2 | | 8/2002 | Stoneburg | |
| 6,450,292 | B1 | * | 9/2002 | Sheffield | 182/205 |
| 6,948,591 | B2 | | 9/2005 | Scott et al. | |
| 2003/0034207 | A1 | | 2/2003 | Palmer et al. | |
| 2003/0230455 | A1 | | 12/2003 | Armstrong | |
| 2008/0078616 | A1 | | 4/2008 | Ursitti | |
| 2008/0196973 | A1 | | 8/2008 | Gomez Lopez | |
| 2008/0230316 | A1 | | 9/2008 | Worthington | |
| 2011/0127110 | A1 | | 6/2011 | Trang | |

* cited by examiner

LADDER LEVELER APPARATUS

This application claims benefit under 35 USC section 119 (e) of provisional application Ser. No. 61/807,582, filed Apr. 2, 2013, entitled LADDER LEVELER APPARATUS, the entire contents of which are incorporated herein by reference.

BACKGROUND OF THE INVENTION

The present invention relates to ladders with leveling devices causing the ladder to adjust to and maintain a true vertical relationship rather than tilt laterally.

Ladder levelers increase the stability and safety of extension ladders, helping reduce the number of injuries and fatalities. For example, see Thocher U.S. Pat. No. 5,273,133. However, improvements are desired to reduce complexity, reduce the number of components, reduce cost of individual components and cost of overall assembly, improve functionality, reduce weight, improve reliability and robustness of the design, while maintaining design flexibility.

SUMMARY OF THE INVENTION

In one aspect of the present invention, a ladder apparatus includes a ladder having side rails and spaced-apart rungs connecting the side rails, and a leveler including an extendable leg positioned inside of and slidably engaging an inside of each side rail. The leveler includes an extension control for controlling simultaneous extension of one of the legs while retracting the other of the legs that includes a transverse rod extending between the extendable legs.

In another aspect of the present invention, a ladder apparatus includes a ladder having side rails and spaced-apart rungs connecting the side rails, and a leveler including an extendable leg slidably engaging each side rail, a leg-leveling extension control for controlling simultaneous extension of one of the legs while retracting the other of the legs when one of the legs engages a ground surface, a locking control for locking both of the legs when both legs engage the ground surface, and a return-to-center centering control for longitudinally centering both legs when both legs disengage the ground surface.

In a narrower aspect of the present invention, the locking control includes a pawl for locking an adjusted position of the leg on an associated one of the side rails, and a four-bar linkage for moving the pawl between a disengaged unlocked position when at least one of the legs is not engaging a ground surface and for driving the pawl to an engaged locked position when both of the legs are engaging the ground surface.

In another aspect of the present invention, a ladder includes side rails connected by multiple rungs, a leveler including extendable legs attached to a bottom section of the side rails, and a foot attached to a bottom of the legs, the foot including a ground-engaging plate with up flanges, a trunion bracket pivoted to the up flanges about a first horizontal axis and pivoted to the bottom of the leveler about a second horizontal axis that is perpendicular to the first horizontal axis.

In another aspect of the present invention, a ladder apparatus includes a ladder with two side rails and spaced-apart rungs rigidly interconnecting the side rails, and a leveler assembly attached to the ladder, the leveler assembly including two legs each slidably coupled to an associated one of the side ralls for linear movement, an extension control including a transverse shaft rotatably but non-translationally supported on each of the side rails with shaft ends engaging the legs to move the legs in opposing directions when a bottom one of the legs is biasingly moved toward the ladder, and a locking control operably engaging each of the shaft ends that locks the legs against the linear movement when a bottom of both of the legs is biased toward the ladder.

In another aspect of the present invention, a ladder leveler assembly is provided for a ladder with two side rails and spaced-apart rungs rigidly interconnecting the side rails. The ladder leveler assembly comprises two extendable legs each adapted and configured to slidably engage one of the side rails for linear movement, a transverse shaft with ends adapted and configured to be supported on the ladder for rotation but not translation, the shaft having shaft ends engaging the legs so that upon rotation the legs move in opposite linear directions, and a locking control operably engaging each of the shaft ends that locks the legs against the linear movement when a bottom of both of the legs are biased toward the ladder.

In another aspect of the present invention, a method ladder of adjusting a ladder to be level on uneven ground, comprises providing a ladder having side rails and spaced-apart rungs connecting the side rails, providing a leveler including extendable legs, attaching the leveler to the ladder including attaching legs operably to an inside of and slidably engaging each side rail, and simultaneously extending one of the legs when a force causes another of the legs to retract.

In another aspect of the present invention, a method of adjusting a ladder comprises providing a ladder having side rails and spaced-apart rungs connecting the side rails, having a leveler attached to a bottom of the side rails, the leveler including an extendable leg slidably engaging each side rail, controlling movement of the legs so that extension of one of the legs simultaneously retracts the other of the legs when one of the legs engages a ground surface, locking both of the legs when both legs engage the ground surface, and longitudinally centering both legs when both legs disengage the ground surface.

These and other features, advantages, and objects of the present invention will be further understood and appreciated by those skilled in the art by reference to the following specification, claims, and appended drawings.

DETAILED DESCRIPTION

Figure 1:
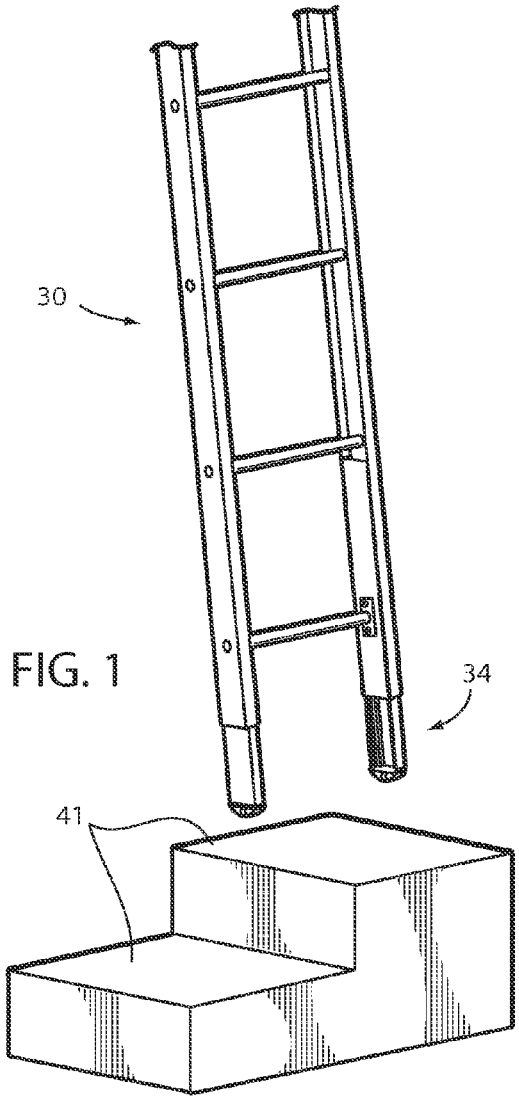
FIGS. 1-3 are perspective fragmentary views of an extension ladder including a leveler assembly embodying of the present invention, FIG. 1 showing the ladder before engaging an uneven ground surface, FIG. 2 showing after the ladder engages the ground surface, and FIG. 3 showing immediately after lifting the ladder from the ground surface.
Figure 2:
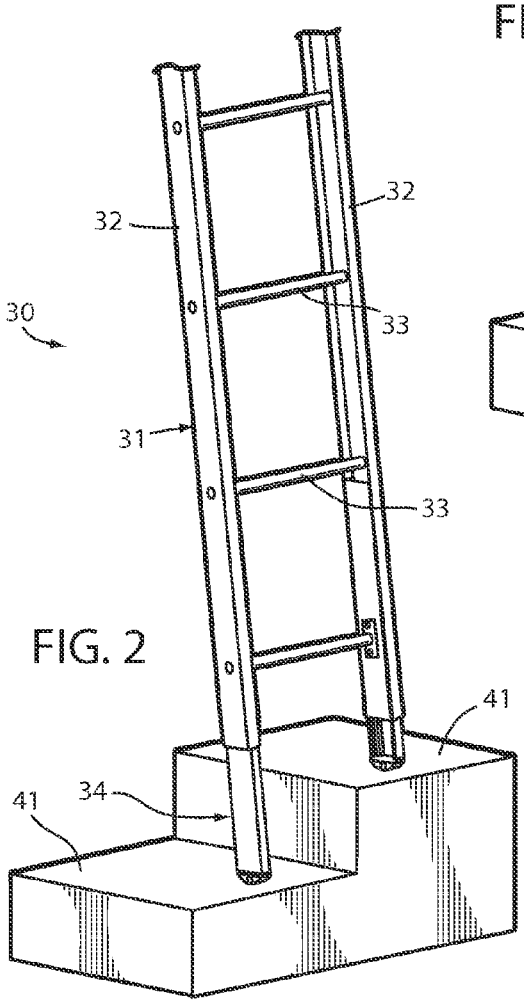
Figure 3:
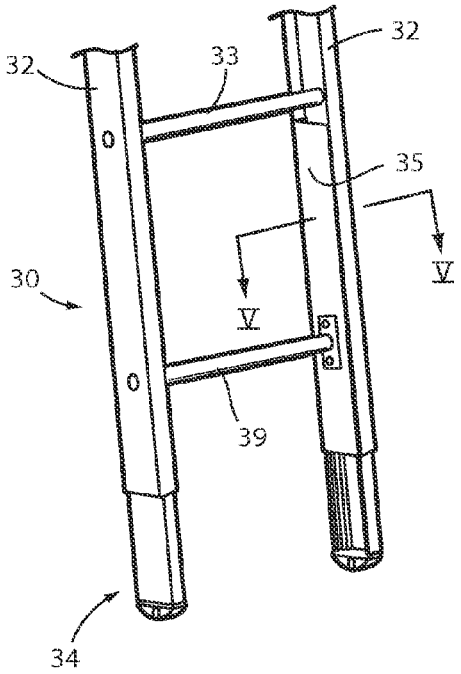
Figure 4:
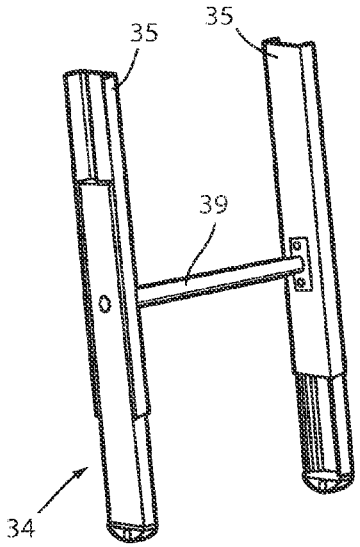
FIG. 4 is a perspective view of the leveler assembly in FIG. 1 (without the pre-assembled ladder).
Figure 5:
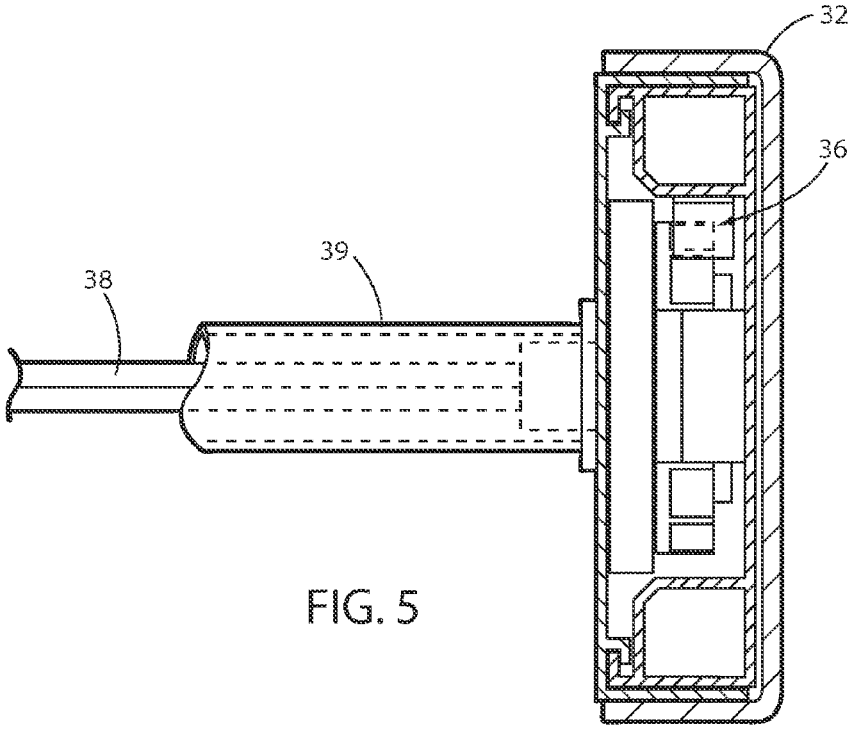
FIG. 5 is a cross section along line V-V in FIG. 3.

The present ladder leveler assembly (also called "leveler" herein is a combination of multiple components attached to a ladder which combine to provide leg-leveling, leg-locking, and leg-return-to-center functions which are independent of each other, but each of which provide a unique contribution to the overall product. These functions correspond to the user interface of 1) leveling a ladder (coordinated extending/retracting legs on each leveler even when uneven ground), 2) keeping a ladder level (locking legs in respective extended/retracted positions), and 3) returning the ladder to an equilibrium position (biasing legs to telescopingly centered positions when removed from a ground engaging position). Specifically, the present leveler design causes both legs to move simultaneously in opposite directions during adjustment when one leg is engaged with a ground surface see FIGS. 1-2), but quickly locks both legs in respective adjusted positions when both legs engage the ground surface and when weight is placed on the ladder (see FIG. 2). The leveler design further causes the legs to return to a telescopingly centered position when the ladder is lifted away for storage or transport (see FIG. 3). The leveler can be substantially preassembled (see FIG. 4) before attachment to a ladder, making the leveler retrofitably attachable to an existing ladder or to a preassembled ladder.

More specifically, the present ladder apparatus 30 (FIG. 1) includes a ladder with side rails 32 and rungs 33 (all of which can be aluminum or other material). A leveler 34 (also called a "leveler assembly") is connected to a bottom of the side rails 32. The illustrated leveler 34 is attached to an inside/inboard surface of each of the side rails 32, and is potentially retrofittable and/or attachable to a pre-assembled ladder (31). The leveler 34 (FIG. 6) includes on each side an anchoring component 35 (extruded, stamped, bent, or rolled), a multi-part mechanism 36, and a telescopingly extendable/retractable leg 37, and further includes a transverse rod 38 and rod-receiving hollow rung 39. The leveler 34 includes a leg-leveling extension control for controlling simultaneous extension of one of the legs 37 while retracting the other of the legs 37 when one of the legs 37 engages a ground surface 41 (see FIGS. 1-2), a locking control for locking both of the legs 37 when both legs 37 engage the ground surface 41 (see FIG. 2), and a return-to-center centering control (see FIG. 3) for longitudinally centering both legs 7 when both legs 37 disengage the ground surface 41.

Figure 8:
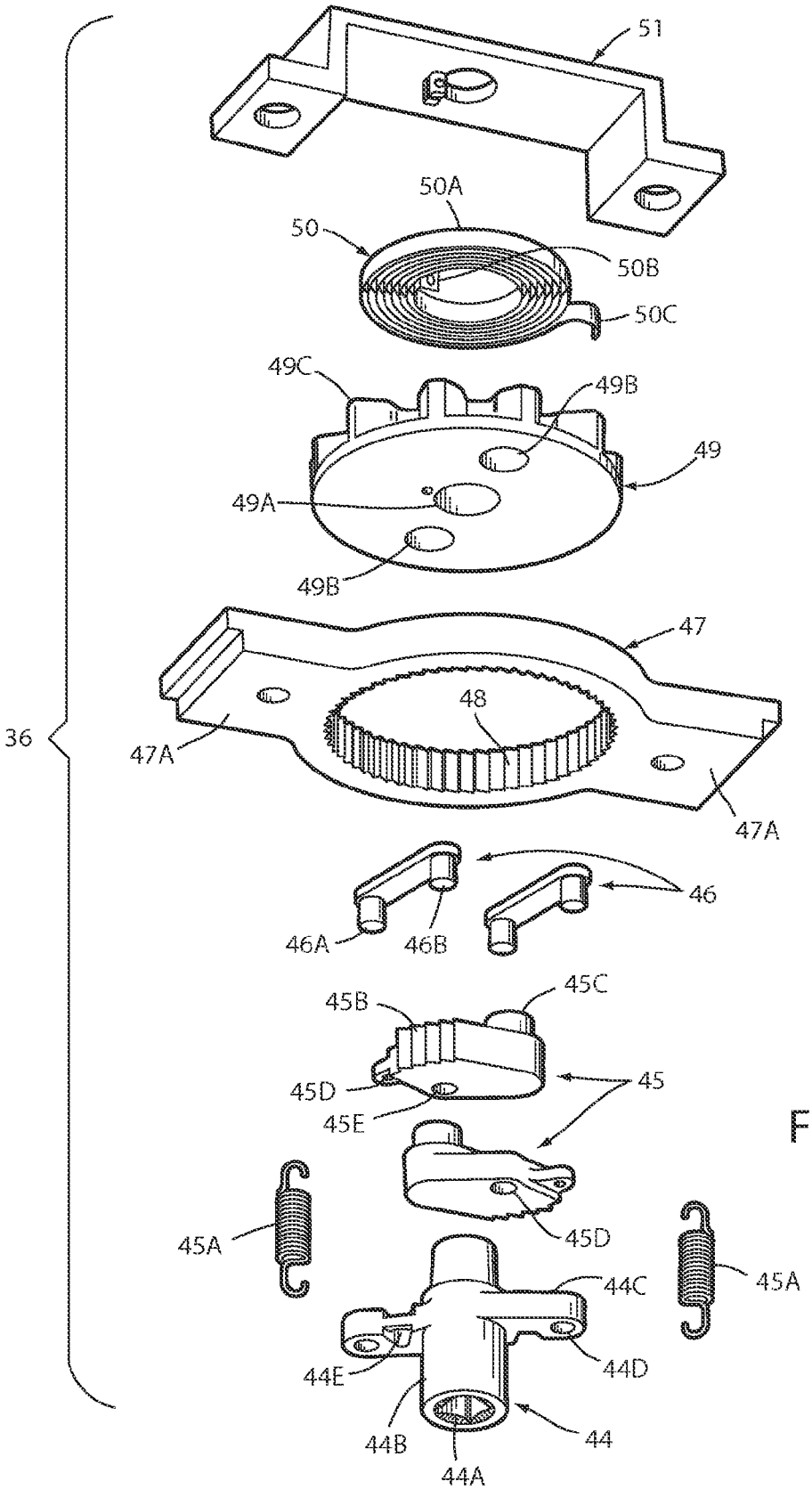
FIGS. 8-9 are exploded front and rear perspective views of the leveler mechanism in FIG. 7A.
Figure 9:
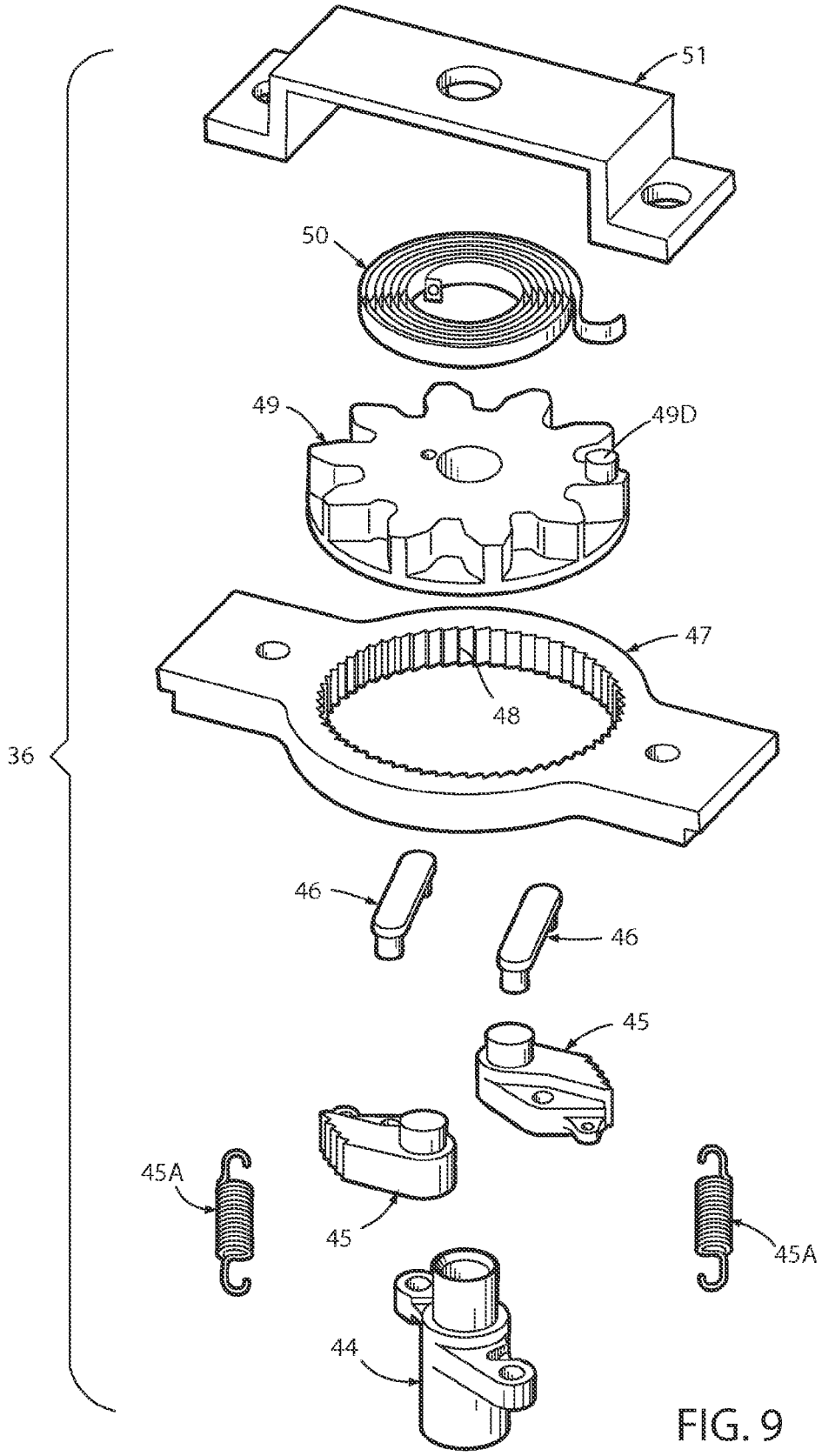
Figure 10:
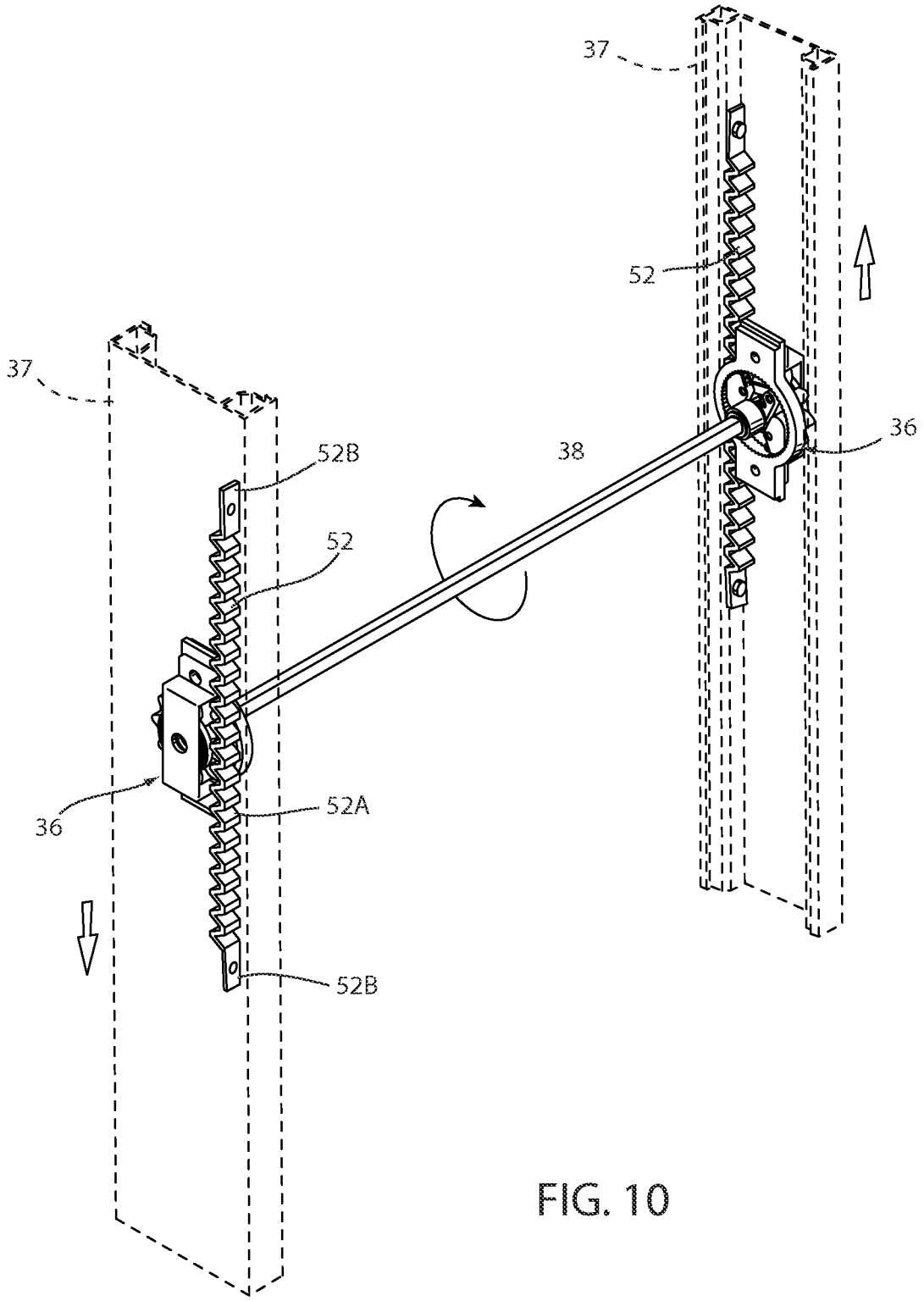
FIG. 10 is a perspective view showing a leveler assembly, with several components of the leveler being in solid lines, but with the legs being shown in dashed lines to better show underlying components, the view including details of a pinion on each side engaging an associated rack of teeth on each side, the racks being arranged to drive the legs in opposite directions when the pinions and transverse rod are rotated.
Figure 11:
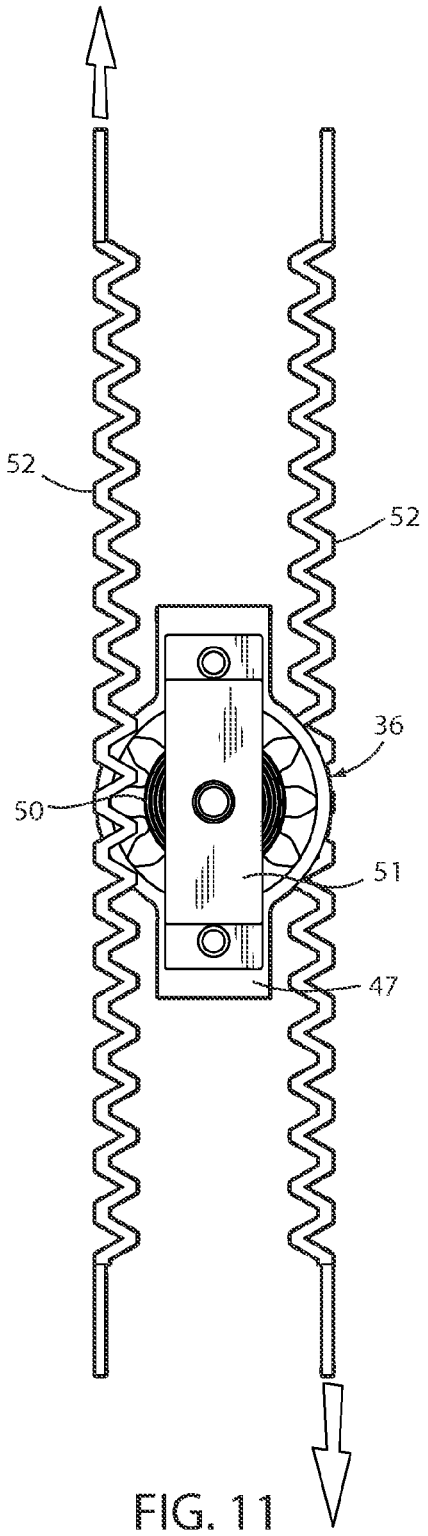
FIG. 11 is a side view of FIG. 10.
Figure 12:
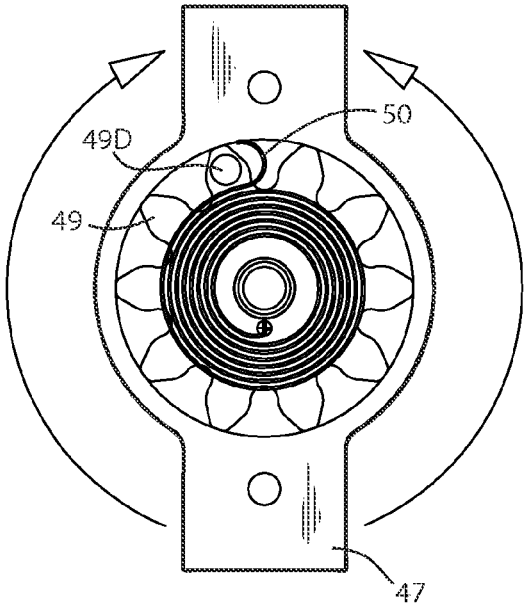
FIG. 12 is an enlarged side view of the leveler mechanism in FIG. 11.
Figure 13:
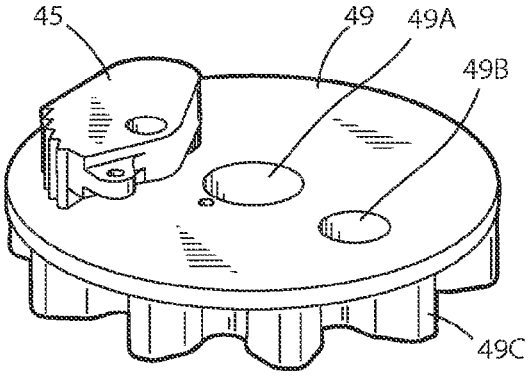
FIG. 13 is a perspective view showing the pinion gear and one pawl, and showing their interrelationship.
Figure 14:
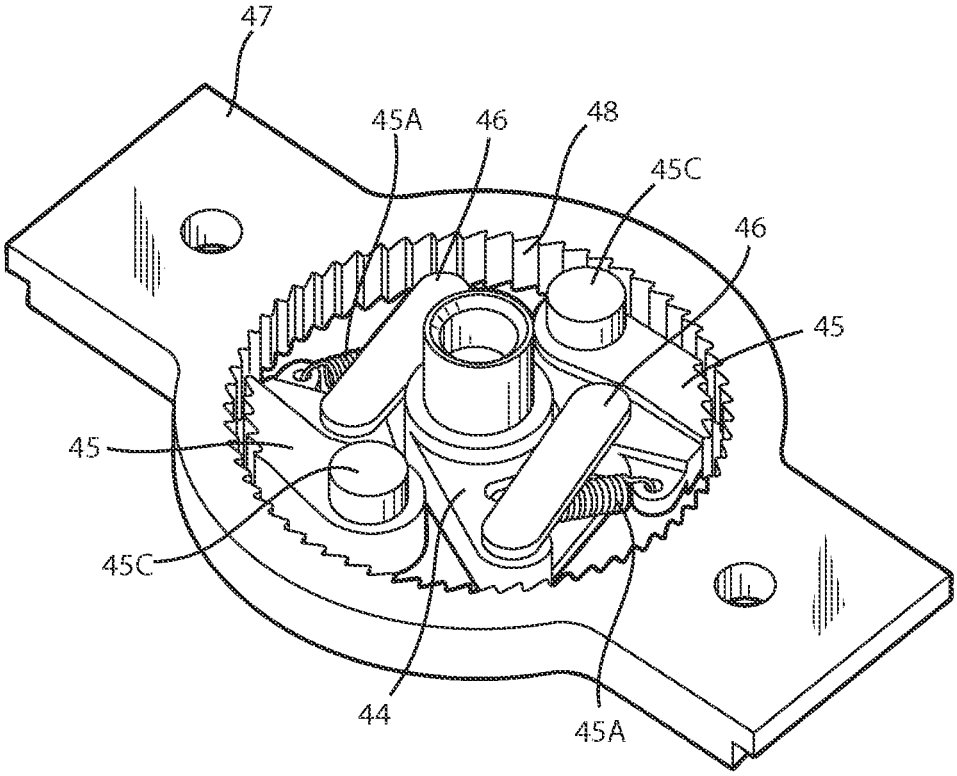
FIGS. 14-15 are perspective views of the leveler pawl locking mechanism, FIG. 14 showing a pawl disengaged position and FIG. 15 showing a pawl engaged position.
Figure 15:
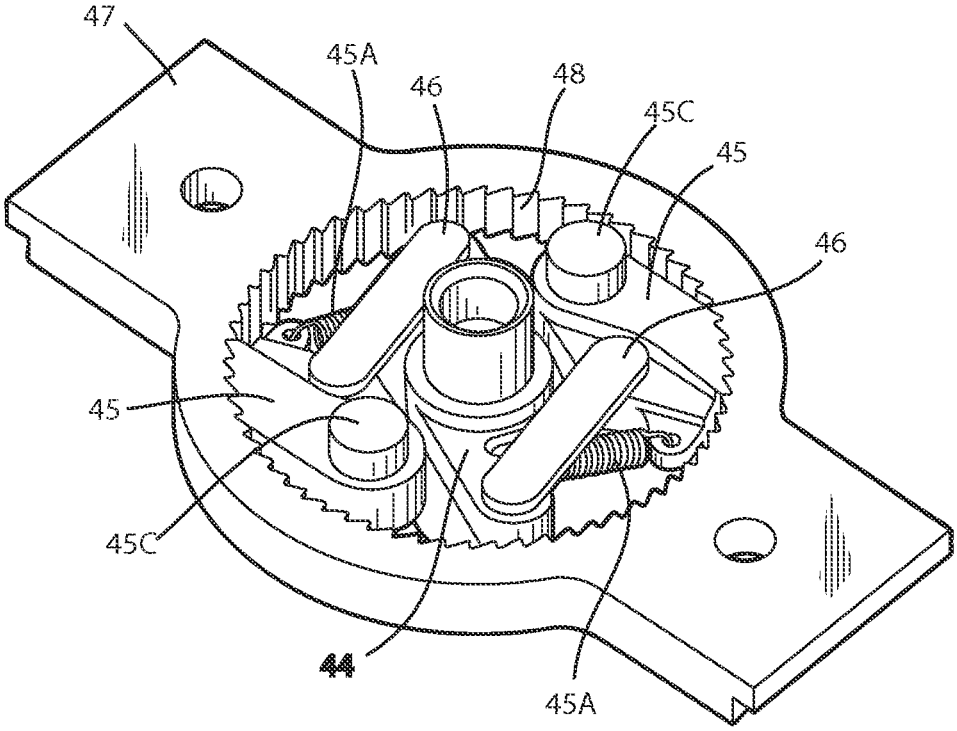
Figure 16:
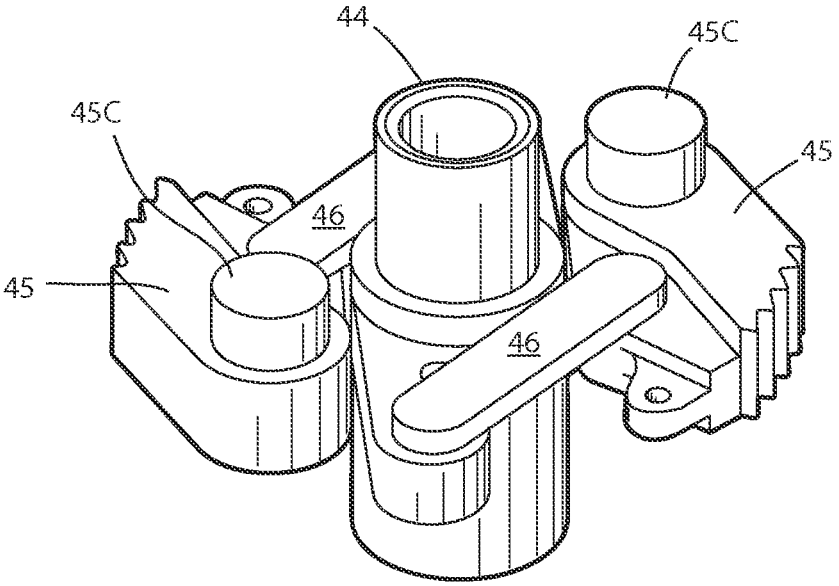
FIGS. 16-17 are perspective views showing parts of the leveler pawl locking mechanism in FIG. 14, FIG. 16 showing the pawls and links, FIG. 17 showing one of the pawls and its return spring.
Figure 17:
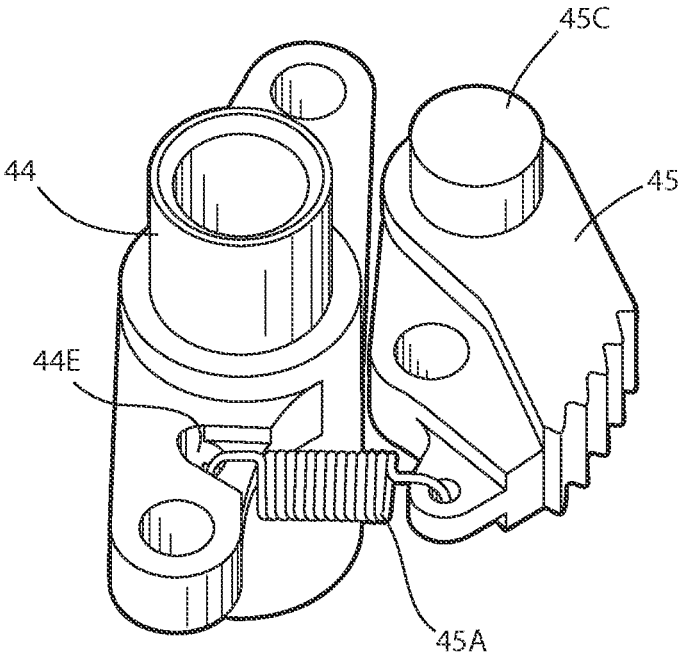

One of the mechanisms 36 is located on each side of the leveler 34 and includes the following components (see FIGS. 6 and 8-9): a configured shaft 44, two pawls 45, two pawl return springs 45A, two links 46, a base component 47, (also called "baseplate") with internal-facing toothed ring (also called an inverse ratchet 48), a pinion 49 (also called "pinion gear"), a spiral centering spring 50, and a top cover 51. Also, a rack 52 (FIG. 10) is attached to each leg 37. The leg-leveling extension control for leg extension includes a combination of the legs 37, racks 52, transverse rod 38, and pinions 49 (see FIGS. 6 and 10-11) (with the mechanisms 36 holding themselves in a disengaged position). The locking control for locking both of the legs 37 includes a combination of the legs 37, the racks 52, the transverse rod 38, pinions 49, and the mechanisms 36 (which includes components 44-51 that operate to lock a position of the legs 37 as explained below) (see FIGS. 14-15, and also FIGS. 13, 16, and 17). The return-to-center centering control (see FIGS. 7B, 8, 9, 11, 12) for longitudinally centering both legs 37 includes a combination of the legs 37, racks 52, transverse rod 38, pinions 49, and centering springs 50 (with the mechanisms 36 being spring-biased back to their disengaged position).

Figure 6:
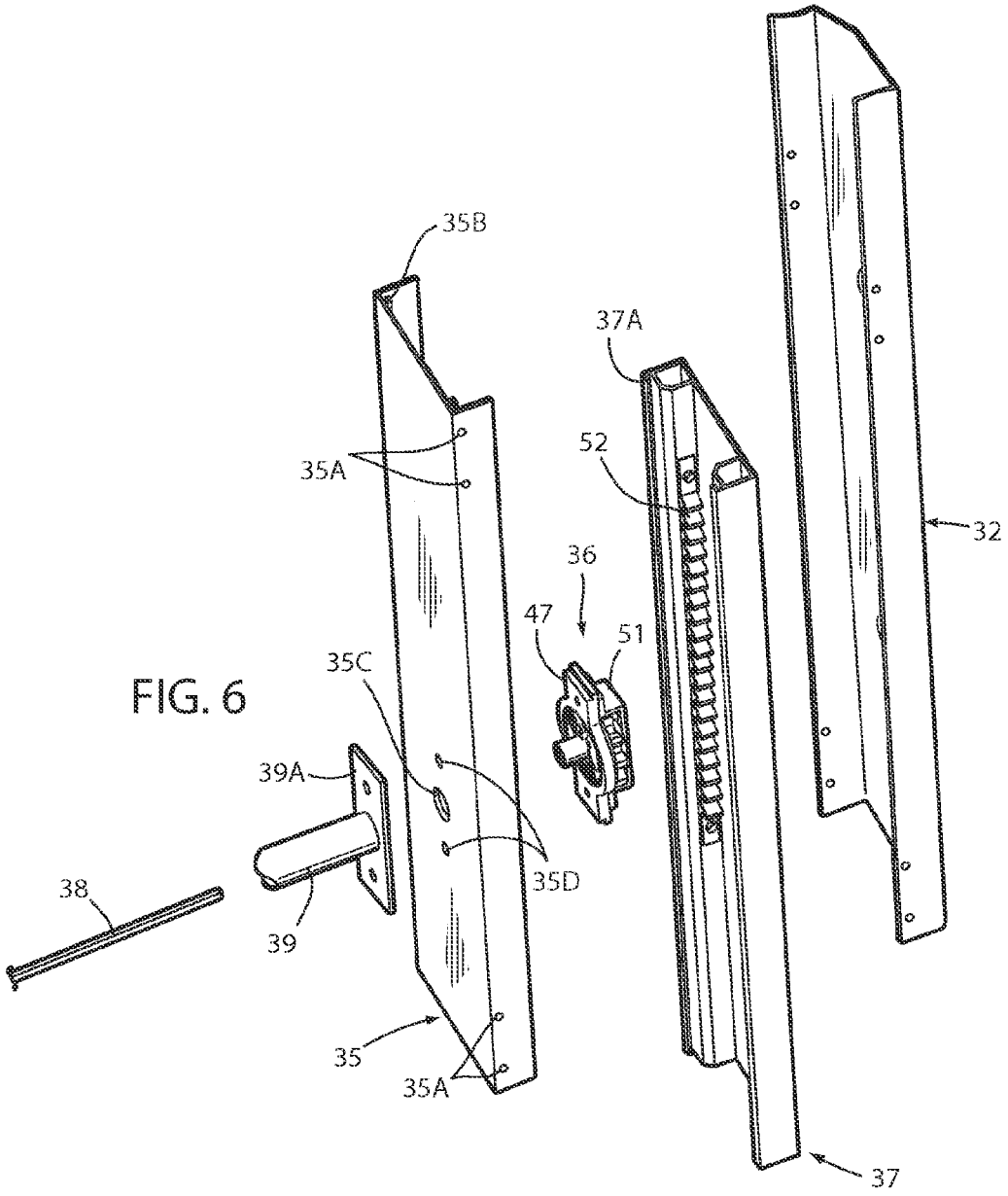
FIG. 6 is an exploded perspective view of a right side rail and leveler assembly in FIG. 3.
Figure 7A:
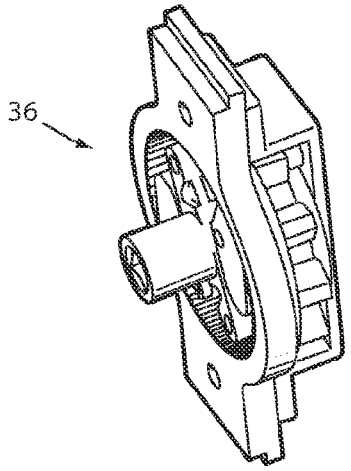
FIGS. 7A-7B are perspective and side views of a leveler mechanism.
Figure 7B:
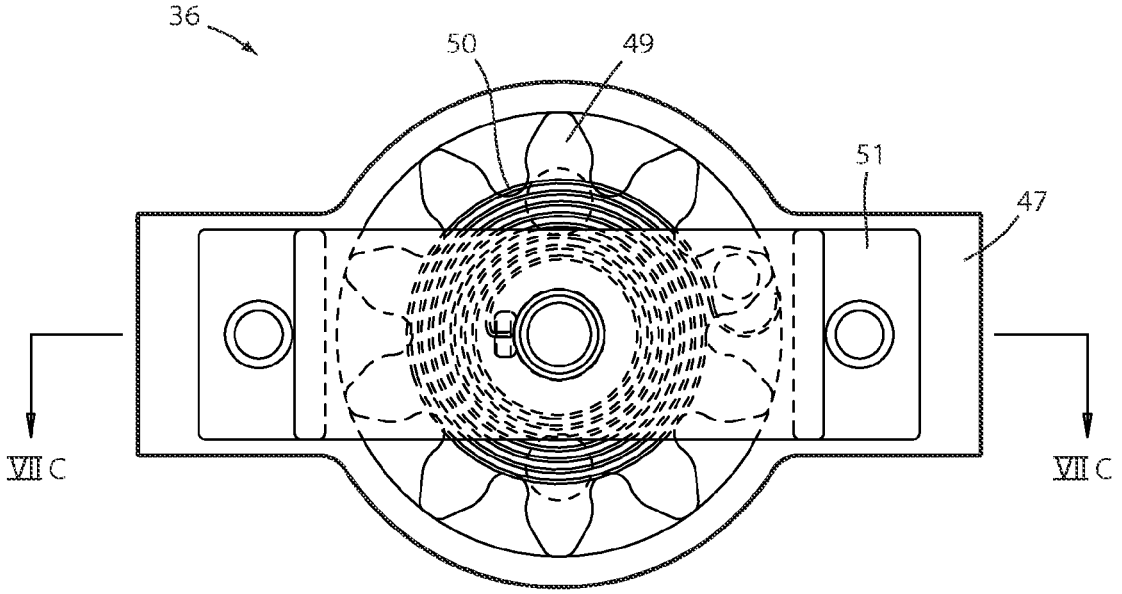
Figure 7C:
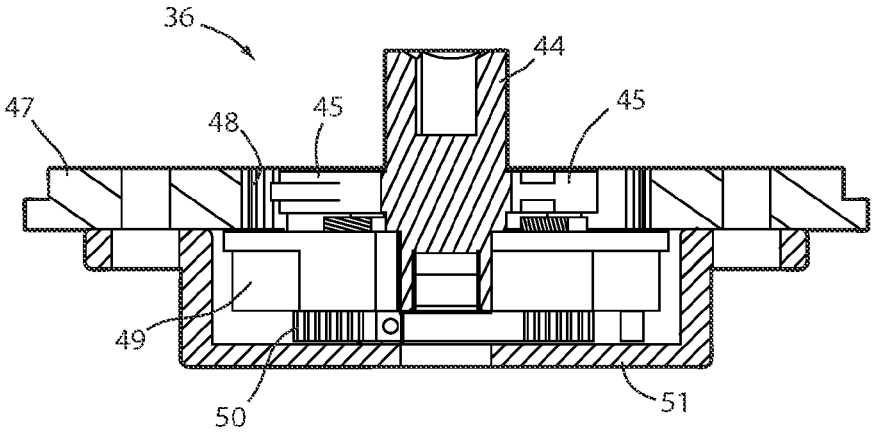
FIG. 7C is a cross section taken along line VIIC-VIIC in FIG. 7B.

The configured shaft 44 (FIGS. 8-9) includes a square socket 44A that engages an end of the transverse rod 38, a shaft portion 44B that extends through and rotates on a center hole 49A in the pinion 49, and arms 44C each with a first hole 44D to engage an end of a link 46 and a second hole 44E to engage an end of the pawl return spring 45A. The two pawls 45 each include a body forming ratchet teeth 45B for engaging teeth 48A on the inverse ratchet 48, a protruding pivot 45C for engaging an off-center hole 49B in the pinion 49, and another hole 45D for receiving another end of the pawl return spring 45A, and another hole 45E for receiving an end of a link 46. The links 46 include a protruding pivot 46A on one end to engage the first hole 44D in the arms 44C and a protruding second pivot 46B to engage the hole 45E in the pawl 45. The base component 47 includes a center section with opening defining the inwardly-facing toothed ring (also called an inverse ratchet 48) and apertured end flanges 47A for attachment to the anchoring component 35 (FIG. 6). The pinion 49 (FIGS. 8-9) includes radially-facing teeth 49C for engaging teeth 52A on the rack 52, and includes the holes 49A and 49B discussed above. The spiral centering spring 50 includes a coiled body 50A with one hook end 50B engaging a stud 51A on the top cover 51, and a second hook end engaging a stud 49D (FIG. 9) on the pinion gear 49. Also, a rack 52 (FIG. 10) includes a strip body forming a linear row of the teeth 52A for engaging the pinion gear 49, aperture ends 52B for fastened attachment to the leg 37.

The anchoring component 35 (FIG. 6) is U-shaped to form a beam structure, and includes holes 35A for fixed attachment to a bottom of the side rails 32. The anchoring component 35 (and/or the side rail 32) includes flanges 35B for sliding engagement with mating flanges 37A on the telescoping leg 37. Hole 35C allows pass-through of the rod 38, and adjacent holes 35D provide for bolt-attachment of the rung bracket 39A of the hollow rung 39, with the same bolts being used to attach the cover 51 to the base component 47 in a manner holding the mechanism 36 together in sandwich-like laminar arrangement between the cover 51 and the base component 47 (and the anchoring component 35). A foot 53 is attached to a bottom of the leg 37.

Leveling Function

Leveling of legs 37 (FIGS. 1-2) is controlled by a leg extension control (also called a "leg extension mechanism") and is done prior to locking of legs 37 in the leveler 34. The leveling period is when one foot 53 is engaged with a grown surface 39 and the two legs 37 are moving in opposite directions relative to each other. The leveling period ends when both feet 53 are engaged with a surface 39, which initiates the locking period. The leveling mechanism includes two racks 52, which are fixed to the legs 37 and are dynamically connected by a rod 38 with two pinions 49, one pinion 49 at either end of the rod 38. As one rack 52 moves up the ladder 31, the pinions 49 will force the other rack 52 to move down the ladder 31. The pinions 49 are fixed axially to the baseplate 47, making translation of the pinion 49 impossible, but free to rotate. The baseplate 47 has features that fix it securely to the ladder 31 and also has features that constrain the leg 37 of the leveler 34 to a single degree of freedom, up and down the side rail 32 of the ladder 31. More detail of each component can be found in the following paragraphs.

Locking Function

The locking function is controlled by a leg locking control (also called a "locking mechanism"). When both feet hit the ground, the racks 52 can no longer move in relation to each other, making the racks 52, the rod 38 and the shaft 44 fixed. The shaft 44 is thus fixed rotationally with the rod 38. As another 5 pounds of force is applied to the ladder 31, the springs 45A which indirectly held the shaft 44 fixed to the pinion 49 are overcome. The pinion 49 rotates independent of the shaft 44 and pushes the pawls 45 out to engage with the inverse ratchet 48 by way of a four-bar mechanism. The four-bar mechanism is formed of the shaft 44, the pawls 45, the links 46, and the pinion 49. The shaft 44 acts as the ground link. When the pawls 45 engage, the load is no longer transferred through the center rod 38 but through the rack 52, pinion 49, pawls 45, and baseplate 47 into the ladder 30. Because of this, the rod 38 only has to take enough load to overcome the force of the pawl-return springs 45A. The components are described in more detail below.

Return to Center Function

Return to center functionality is controlled by a leg centering control (also called a "centering mechanism"). The return to center functionality is dependent on two individual centering springs 50, one spring 50 per side. When the first leg 37 comes in contact with the ground surface 41 the return to center spring 50 on that same side will be loaded in torsion until the opposite leg 37 contacts the ground surface 41. While the leveler 34 is locked and in use, the spring 50 will continue to remain loaded until the ladder 30 is lifted off of the ground 41. When the ladder 30 is lifted from the ground 41, the loaded spring 50 will return the system to equilibrium. The lock springs 45A, will disengage the locking mechanism (i.e. move the pawls 45 to their disengaged position the return to center spring 50 will rotate the pinion 49 transferring motion to the opposite side, and the legs 37 will be brought back to an equilibrium position. Only one of the springs 50 will be loaded at a time and thus the return to center springs 50 will not affect the locking force needed for the entire system. The spring 50 on the non-loaded side, where the leg 37 is translating downward, will be free to rotate and thus be equally unaffected.

The following concerns leveling functional components, the legs 37, and physical design. The legs 37 are the primary physical entities that give the desired leveling motion. They are weight bearing and require user input to move to the desired height. The illustrated leg 37 is an extruded aluminum piece (FIG. 6) It combines with the anchoring component 35A, the side rail 32, and components in the mechanism 36 to hold the rack 52 in place, which is how it couples lateral motion of the legs 37 with the rotating pinion. Notably, it is contemplated that the leg 37 can be many different profiles and cross sectional shapes, and that it can be made of many different materials other than aluminum, such as polymeric materials (reinforced or not), composites, other metals, and hybrid products combining different materials.)

The functional characteristics: The legs 37 move opposite and relative to each other, which decreases the amount each individual leg 37 has to move to obtain the desired height differential. The width and height is determined by a width of the mechanism 36, which width is preferably minimized for material and reduced physical size, but made to have width sufficient for a particular extension ladder. It can be sized for standard extension ladders 30. Wall thickness may vary as needed to satisfy functional and aesthetic requirements, such as to provide sufficient bending loads for particular applications.

Component interfaces: Depending on a selected foot design, a unitary stationary (non-pivoted) the foot 53 (FIGS. 1+18) can be retained at leg bottom, such as by rivets or other fasteners. A plastic cap on the foot 53 is shaped to provide ground-engaging friction regardless of ladder angle. Alternatively, an articulating foot can be used that can be pivoted about perpendicular horizontal axes.

The leg design of the leveler 34 is dependent on the locking and leveling design. It is contemplated that a variety of different legs 37 can be utilized, and that the present innovations can accommodate different leg designs and functional requirements. Simple cross sectional design changes can be made according to leveler design requirements.

Rack: The illustrated rack 52 (also called a "track" herein) is a stamped corrugated steel or metal part that creates a row of teeth (i.e. a "teeth pattern". Each end of the rack 52 is attached to the leg 37, such as by a rivet or other fastener. It is contemplated that the rack 52 could be integrally formed as part of the base component 47, or that it can be a weldment or otherwise formed, if desired. The illustrated rack 52 includes ends attached to the leg 37 and a rivet is placed through the holes in unison with the leg for permanent hold.

The rack 52 is designed with sufficiently thick steel to avoid failures, such as at potential shear points. The teeth profile matches the teeth profile of the pinion 49. The rack 52 remains stationary in the leg 37 and moves tangential to the rotating pinion 49.

Pinion 49: The physical design of the pinion teeth match the rack 52 for smooth and good-functioning movement. The pinion 49 can be made of a powdered metal via a powder metallurgy process. Alternatively, the pinion 49 can be made by other materials (such as plastic or steel) and other processes (such as injection molding or machining), depending on physical requirements of a particular ladder assembly. A diameter of the pinion 49 is constrained to the size of the typical extension ladder side rail 32 and leg 37.

The pinion's curved profile is designed to engage with a flat surface of the rack 52 allowing for multiple teeth engagement at one time. An abutting flat surface on the pinion bottom keeps the pinion 49 in line with rack 52, eliminating shifting or slop of movement, and prevents bunching of components. The major hole in a center of the pinion 49 interfaces with the shaft 44 with a clearance fit allowing rotation. The small hole on the top face mates with the return to center spring 50. The two off center holes in the pinion 44 mate with the bosses on the pawls 45.

Base components 47: The base components 47 on the inside-of-ladder version (FIGS. 1-3, 5-6) include a side-rail-attached anchoring component 35 and a base component 47 with an inverted gear (i.e. inverse ratchet 48). The anchoring component 35 that fixes the base plate 47 to the associated side rail 32 of the ladder 31. The illustrated base component 47 is stamped or extruded aluminum, but it can be made in other ways. The base components 47 serve as a foundation for the entire ladder attachment. A thickness of the base component 47 is made sufficient for loads from the engaged ladder 31/34. Holes in the base component 47 are predrilled and the entire system is bolted to the inside of the using holes at top and bottom ends of the anchoring component 35. Each leg 37 connects to an associated base component 47 and runs up and down the stationary base component 47 and anchoring component 35 through side slots. This serves as the alignment for the rod 38, and shaft 44 through center hole 49A. It is contemplated that the base component 47 can be one machined piece or a large powdered metal piece.

Rod 38: The illustrated rod 38 is extruded square aluminum, but it is contemplated that other materials and/or processes can be used to form the rod. The rod 38 is fed through a rung 39 during assembly (FIGS. 5-6) of the leveler 34. The rod 38 couples each locking system in which the legs 37 move dependently of each other. Specifically, the rod 38 makes the legs 37 move in opposite directions, because of a same direction of rotation but due to an "opposite" or "mirrored" engagement of the pinion 49 and rack 52 at each end of the rod 38. The rod's ends fit into mating square aperture on either side of the configured shafts 44.

Figure 18:
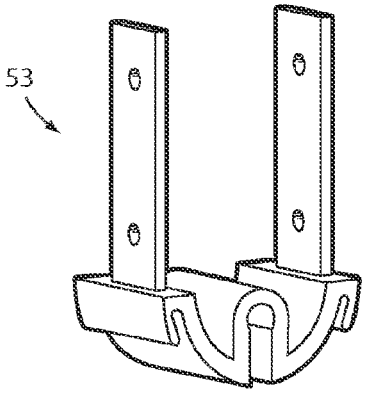
FIG. 18 is a perspective view of a foot shown in FIG. 1.

Foot 53: The illustrated foot 53 connects by rivets to a bottom of each leg 37. The fixed non-pivoted foot 37 (FIG. 18) includes an extruded aluminum profile. A bottom of the foot has a slot for receiving an inserted rubber or plastic pad. The foot 53 is designed to make good frictional contact with a ground surface 41, and to limit debris entering the locking system. Flanges on the foot 53 fit inside of the leg 37 through side slots and also a body of the foot 53 mates with a leg bottom surface.

Figure 19A:
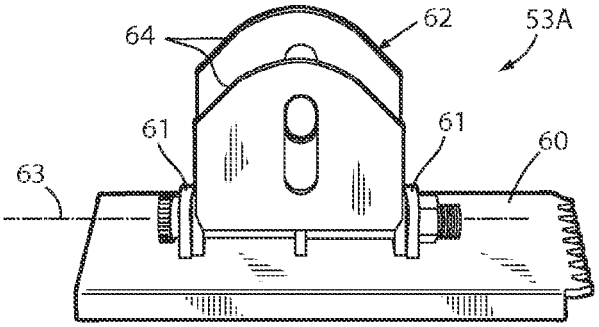
FIGS. 19A-19C are perspective, side and front views of an alternative foot pivoted about perpendicular axes to self-adjust to an uneven ground surface.
Figure 19B:
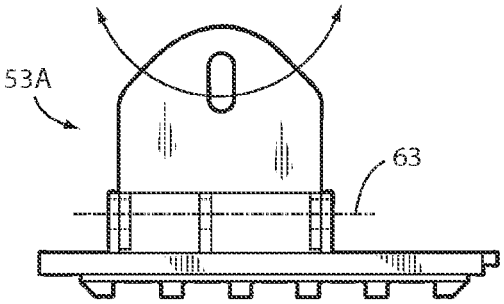
Figure 19C:
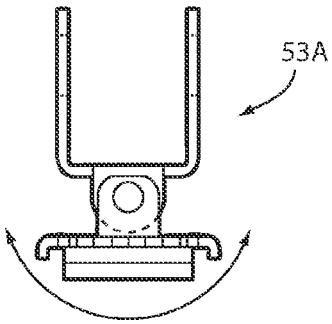

Modified foot 53A (FIGS. 19A-19C): It is contemplated that alternative feet can be attached to the ladder apparatus. The modified foot 53A (FIGS. 19A-19C) includes a bottom plate 60 configured to frictionally engage a ground surface 41, and can include short downwardly formed edges or teeth for hi-friction engagement. The bottom plate 60 includes up flanges 61, and the foot 53A includes a U-shaped trunion bracket 62 with bottom portion pivoted to the up flanges for pivoting about a first axis 63 and with an upper portion defining a pair of flanges 64 for pivotally engaging a bottom of the associated leg 37 for attachment to legs 37. This allows the foot 53A to adjust to an abutting ground surface 41, regardless of an angle of the ground surface 41. Notably, the bottom plate 60 has a sufficient width and length, and the axis 62 is relatively close to the leg 37, such that the foot 53A does not tend to roll, despite being set on a ground surface 41 having an angle of several degrees off horizontal plane.

Figure 20A:
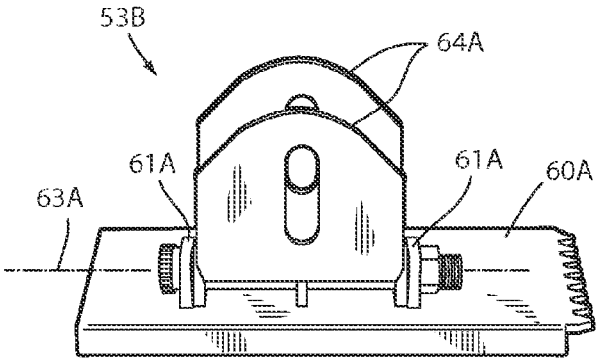
FIGS. 20A-20B are perspective and front views of another alternative foot pivoted about perpendicular axes to self-adjust to an uneven ground surface, where the axes are located offset to the attachment brackets so that a bottom of the foot is centered under the ladder side rail (rather than centered under the leveler's extendable leg).
Figure 20B:
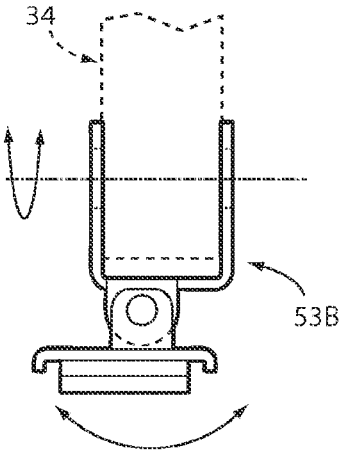

A second modified foot 53B (FIGS. 20A-20B) is similar to the first modified foot 53A (FIGS. 19A-19C) but in the second modified foot 53B the first axis 63A is located toward an outboard side of the U-shaped trunion bracket 62A. This tends to better locate a center of the footprint of the second modified foot 53B directly under the side rail 32 of the associated ladder 31 (keeping in mind that the illustrated leveler assembly is attached to an inside of the side rails 32). Further, this spaces the two feet 53B farther apart on the ladder assembly 30, providing more stability to the overall assembly on a ground surface 41.

Locking Functional Components

Once both feet 53 (or 53A or 53B) engage the ground, the pinions 49 counter-rotate on their respective shafts 44. The counter-rotation of the pinion 49 forces the pawls 45 to move radially outward and engage with the inverse ratchet 48. The illustrated pawls 45 are powder metallurgy components with very precise teeth profile. The pawls 45 serve as fundamental components of locking mechanism. They rotate about the boss on top protruding into the pinion 45, and require only a small movement to engage with teeth on the inverse ratchet 48. Thus they engage with the associated inverse ratchet 48 to lock the legs 37 against further movement while weight is on the ladder 30. They are coupled to the shaft 44 through the link 46 which is placed inside the larger through hole. Springs 45A are attached to the pawls 45 for moving the pawl 45 to a disengaged position (i.e. unlocking the system) when the load is removed. The springs 45A are attached to the associated pawl 45 inside the small through hole. The cylindrical boss on top of the pawl 45 mates with pinion holes 49B. It is noted that the illustrated pawls 45 and/or springs 45A can be recessed into the pinion 49 if desired.

Links 46 are used to move the pawls 45 between disengaged and engaged positions on the inverse ratchet 48. The links 46 are a powder metallurgy steel parts, or can be made of other materials. Their purpose is to cause pawl 45 movement to the engaged position when the rod 38 cannot cause the pinions 49 to rotate (due to both legs engaging a ground surface). Hence the resulting forces between the four bar linkage (where the linkage is formed by the rod 38 engaging the shaft 44, the shaft 44 engaging the link 46, the links 46 engaging the pawls 45, the pawls 45 moveable to engage teeth on the inverse ratchet 48) cause locking of the legs 37 in a desired ladder-leveled position. Specifically, when the pinion 49 rotates independent of the shaft 44 (i.e. the rod 38/shaft 44 can't rotate, but the pinion 49 can), the links 46 cause the pawls 45 to rotate into the inverse ratchet 48. (Contrastingly, when the pinion 49 rotates with the shaft 44, the links 46 are not biased . . . and hence the springs 45A cause the pawls 45 to rotate to a disengaged position where they rotate with the rod 8 (and with the links 46) as a unit on the associated pinion 49. Each pawl-biasing link 46 inserts into the hole on the pawl 45 and the shaft 44.

The shaft 44 (also called a "rod terminating end bracket" herein) is potentially a powder metallurgy part, although it is contemplated that it can be made in other ways. It has machined surfaces for interfacing with the link 46, spring 45A, and rod 38. The shaft 44 rotates with the pinion 49 until both legs 37 engage a surface 41, and then it ceases rotation. The shaft 44 mates the rod 38 through its bottom square hole. It also mates with link 46 through larger through holes, and mates with lock springs 45A through small holes.

The base component 47 with inverted gear 48 has a body/plate with apertured ends configured for attachment to mating parts, such as by rivets for attachment to the anchoring component (FIG. 6). The inverted gear 48 ring is formed integrally into the base component 47, including machining to achieve the required accuracy. The inverted gear 48 is important for good operation and to avoid "system failure". The base component 47 serves as the alignment for the rod 38, and shaft 44 in lock as they are place inside the large through hole. Notably, it is the rod 38 that acts as a compliant member to correct misalignment of the pawls 45 and the inverse ratchet 48 during locking.

Return to Center Functional Components

The return to center functional components include a centering spring 50 on each side. The illustrated centering spring 50 is a spring steel wound into a coil lying in a single plane, and is designed to provide a relatively constant force for 360 degrees of rotation of the pinion 49. The spring 50 lies adjacent the pinion 49 under the cover 51 (also called a "top" or a "lock housing"), and has one spring end attached to the pinion 49 via a protrusion that extends from tooth on the pinion 49, and one spring end attached to the cover 51 (which is stationary) via a hook on the one spring end that engages a protrusion in the cover 51.

Lock Housing

The lock housing 51 (also called a cover) (FIGS. 7A-7C, 8, 9) covers and protects the locking system. A major purpose is to keep the assembly properly stacked. It can be made from metal or potentially by an injection molded plastic, and made to snap onto the base component 47. A height of the housing 51 is accurately modeled to not allow axial movement of the stacked components (so that they stay "squished" together for proper function). A hole in lock housing 51 serves as an alignment for the shaft 44. Top and bottom of the housing are attached to the base component 47 by fasteners that also attach the leveler rung 39 (FIG. 6). It is contemplated that the cover can be bent aluminum bolted or otherwise fixed in place, and that it can have various shapes and dimensions as needed for a particular ladder construction.

Lock Spring

The lock springs 45A are sized and configured so that when load is removed from the locking system, the force of the lock spring 45A pulls the associated pawl 45 back inward (i.e. to their disengaged positions). The spring force must be sufficient to pull the pawls away from engagement.

Modification

Figure 21:
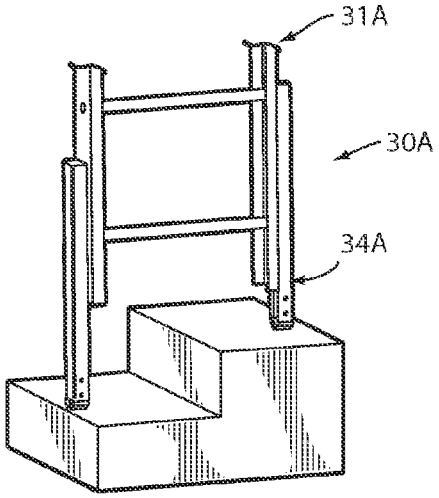
FIG. 21 is a view of the ladder in FIG. 4 where the leveler assembly is attached to an outside surface of the side rails of the ladder, but where the leveler assembly is adjusted to engage an uneven ground surface.
Figure 22:
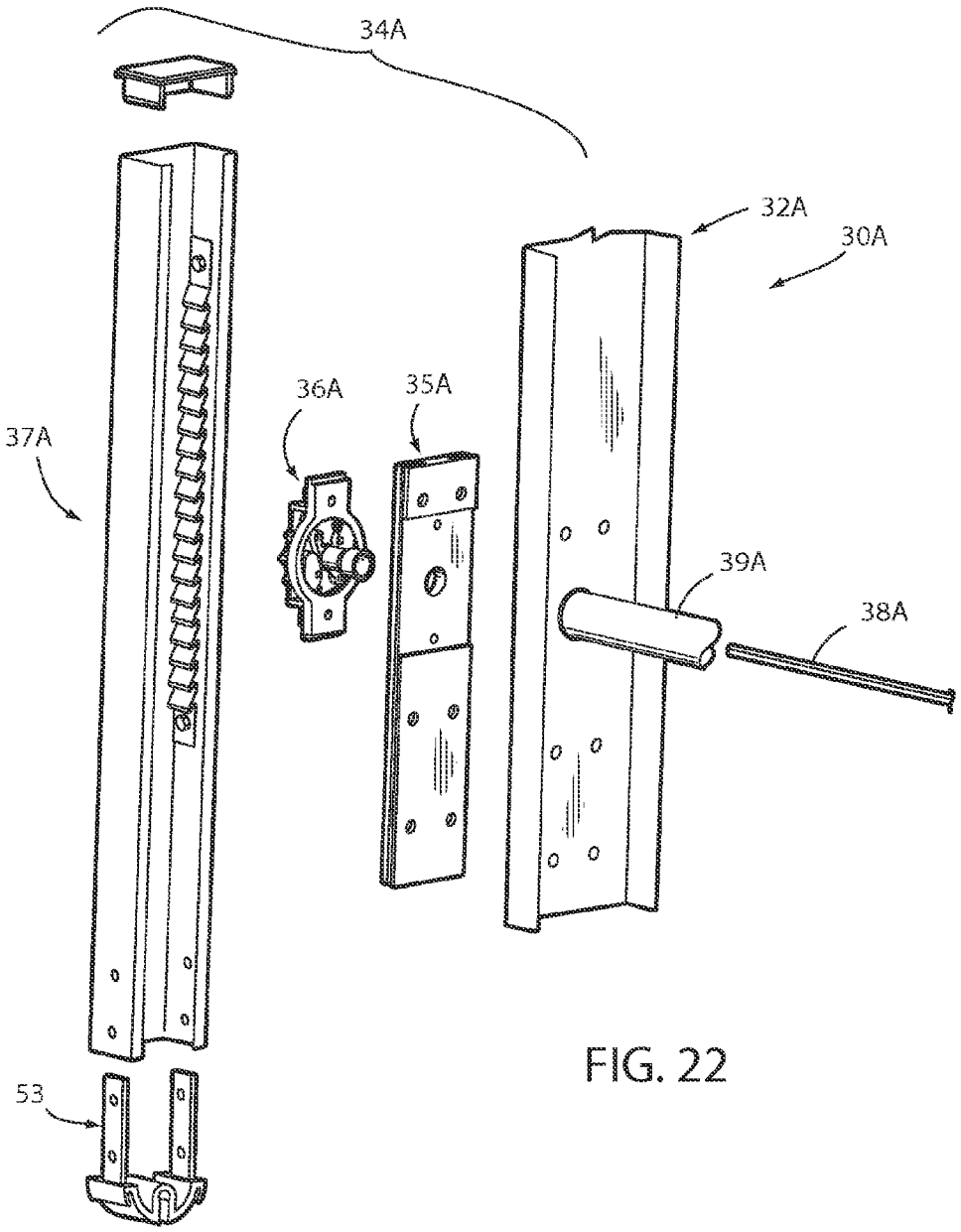
FIG. 22 is an exploded perspective view of a left side portion of FIG. 21.

It is contemplated that a leveler 34A (FIGS. 21-22) can be attached to an outside surface of side rails 32A of a ladder 31A. The leveler 34A includes similar components, but the anchoring component (35, FIG. 6) is modified to an anchoring component 35A (FIG. 22) that is located between the side rail 32A and the leg 37A. A mechanism 36A having similar components and function to mechanism 36 is provided. The rod 38A extend through the side rail 32A, and the rung 39A receiving the rod 38A is attached between the side rails 32A.

It is to be understood that variations and modifications can be made on the aforementioned structure without departing from the concepts of the present invention, and further it is to be understood that such concepts are intended to be covered by the following claims unless these claims by their language expressly state otherwise.

The invention claimed is:

1. A ladder apparatus comprising:

a ladder having side rails with a C-shaped cross section each defining an inwardly-facing cavity, and spaced-apart rungs connecting the side rails; and a leveler including an anchoring component having an outwardly-facing C-shaped cross section attached to an inboard surface of each side rail and further including an extendable leg positioned between the anchoring component and the side rail on each side and still further including a fixed rung extending between and fixedly secured to the anchoring components, the leveler further including an extension control for controlling simultaneous extension of one of the legs while retracting the other of the legs, the extension control including a multi-part mechanism positioned inside the side rail on each side between the anchoring component and the side rail for moving the extendable legs and including an actuator extending between the multi-part mechanism and between the anchoring component on each side rail.

2. The ladder apparatus defined in claim 1, wherein the leveler is preassembled prior to attachment to the side rails.

3. The ladder apparatus defined in claim 1, wherein the extension control includes a rod extending between the extendable legs, the rod having frictional-generating ends that engage a mating surface on the legs to simultaneously extend the one leg while retracting the other leg.

4. The ladder apparatus defined in claim 1, wherein the leveler includes base components attached to the side rails and includes a rung extending between the base components.

5. The ladder apparatus defined in claim 1, including a locking control for locking both of the legs when both legs engage the ground surface, and a centering control for longitudinally centering both legs when both legs disengage the ground surface.

6. A ladder apparatus comprising:

a ladder having side rails defining an inwardly-facing C-shaped cross section and spaced-apart rungs connecting the side rails; and a leveler including an anchoring component defining an outwardly-facing C-shaped cross section assembled to an inboard surface of each side rail and further including a fixed rung fixedly secured between the anchoring components and still further including an extendable leg slidably engaging each side rail between each side rail and assembled anchoring component, the leveler also including a leg-leveling extension control for controlling simultaneous extension of one of the legs while retracting the other of the legs when one of the legs engages a ground surface, a locking control for locking both of the legs when both legs engage the ground surface, and a return-to-center centering control for longitudinally centering both legs when both legs disengage the ground surface.

7. The ladder apparatus defined in claim 6, wherein the locking control includes a pawl for locking an adjusted position of the leg on an associated one of the side rails, and a four-bar linkage for moving the pawl between a disengaged unlocked position when at least one of the legs is not engaging a ground surface and for driving the pawl to an engaged locked position when both of the legs are engaging the ground surface.

8. The ladder apparatus defined in claim 1, including:

a foot attached to a bottom of each of the legs, the foot including a ground-engaging plate with up flanges, a trunion bracket pivoted to the up flanges about a first horizontal axis and pivoted to the bottom of the leveler about a second horizontal axis that is perpendicular to the first horizontal axis.

9. The ladder apparatus defined in claim 8, wherein the first and second horizontal axis define an intersection point located generally under a footprint of the side rails and that is not centered under a footprint of the extendable legs.

10. A ladder apparatus comprising:

a ladder with two side rails defining an inwardly-facing C-shaped cross section and spaced-apart rungs rigidly interconnecting the side rails; and a leveler assembly attached to the ladder, the leveler assembly including an anchoring component defining an outwardly-facing C-shaped cross section assembled to an inboard surface of each side rail and further including a fixed rung fixedly secured between the anchoring components and still further including two legs each slidably coupled to an associated one of the side rails for linear movement, an extension control including a transverse shaft rotatably but non-translationally supported on each of the side rails with shaft ends engaging the legs to move the legs in opposing directions when a bottom one of the legs is biasingly moved toward the ladder, and a locking control operably engaging each of the shaft ends that locks the legs against the linear movement when a bottom of both of the legs is biased toward the ladder.

11. The ladder apparatus in claim 10, wherein the leveler assembly includes two base components each attached to one of the side rails and operably engaging an associated one of the shaft ends.

12. The ladder apparatus in claim 10, wherein the locking control includes a friction device near each leg that is movable between a locked position preventing rotation of an associated one of the shaft ends and a released position allowing rotation.

13. The ladder apparatus in claim 12, wherein the friction device comprises a pawl.

14. The ladder apparatus in claim 10, wherein the legs each have a longitudinally centered position and also have extended and retracted positions, and wherein the extension control includes at least one spring biasing the legs to the longitudinally centered position.

15. The ladder apparatus in claim 10, wherein the leveler assembly includes base components configured for retrofit attachment to the side rails of an existing pre-assembled ladder.

16. The ladder apparatus in claim 10, wherein the legs each include a foot supported on a bottom of the legs for multi-axial movement to engage an angled ground surface while supporting the ladder apparatus in a stable upright position.

17. A ladder apparatus comprising:

a ladder with two side rails and spaced-apart rungs rigidly interconnecting the side rails; and a leveler assembly attached to the ladder, the leveler assembly including two legs each slidably coupled to an associated one of the side rails for linear movement, an extension control including a transverse shaft rotatably but non-translationally supported on each of the side rails with shaft ends engaging the legs to move the legs in opposing directions when a bottom one of the legs is biasingly moved toward the ladder, and a locking control operably engaging each of the shaft ends that locks the legs against the linear movement when a bottom of both of the legs is biased toward the ladder;

wherein the locking control includes a friction device near each leg that is movable between a locked position preventing rotation of an associated one of the shaft ends and a released position allowing rotation;

wherein the friction device comprises a pawl;

wherein the extension control includes a pinion on each end of the shaft engaging a rack on each associated side rail for extending the legs in opposite directions, and the locking control includes a ring ratchet connected to the pinion with the ring ratchet being located adjacent each leg for engagement by an associated one of the pawls.

18. The ladder apparatus in claim 17, wherein each locking control includes a four bar linkage controlling movement of the pawl; the four bar linkage including associated ones of the pawl, the shaft, the pinion, and at least one link; the pawls each being pivoted to the pinion and configured to selectively engage the associated ring ratchet to lock against movement of the legs, the shaft including at least one arm with the at least one link extending between an associated one of the arms and an associated one of the pawls for moving the pawl when the shaft is fixed against rotation while the ring ratchet is biased to rotate.

* * * * *